US011280538B2

(12) United States Patent
Ivanov

(10) Patent No.: US 11,280,538 B2
(45) Date of Patent: Mar. 22, 2022

(54) BIFUNCTIONAL COMPRESSION REFRIGERATOR

(71) Applicant: Vladimir Kirillovich Ivanov, Moscow (RU)

(72) Inventor: Vladimir Kirillovich Ivanov, Moscow (RU)

( * ) Notice: Subject to any disclaimer, the term of this patent is extended or adjusted under 35 U.S.C. 154(b) by 0 days.

(21) Appl. No.: 17/275,773

(22) PCT Filed: May 9, 2020

(86) PCT No.: PCT/RU2020/050094
§ 371 (c)(1),
(2) Date: Mar. 12, 2021

(87) PCT Pub. No.: WO2021/025594
PCT Pub. Date: Feb. 11, 2021

(65) Prior Publication Data

US 2022/0057132 A1 Feb. 24, 2022

(30) Foreign Application Priority Data

Aug. 8, 2019 (RU) ..... RU2019125181

(51) Int. Cl.
*F25D 23/00* (2006.01)

(52) U.S. Cl.
CPC .... *F25D 23/003* (2013.01); *F25D 2323/0022* (2013.01)

(58) Field of Classification Search
CPC ..... F25D 23/003; F25D 2323/0022; F25D 2323/0023; F25D 2323/0024; F25D 23/10;
(Continued)

(56) References Cited

U.S. PATENT DOCUMENTS 2,984,086 A * 5/1961 Wertheimer ..... F24F 1/0003 62/262
9,080,801 B2 7/2015 Arjomand
(Continued)

FOREIGN PATENT DOCUMENTS

CN 2264347 Y 10/1997
CN 106949614 * 7/2017 ..... F24F 2110/00
(Continued)

OTHER PUBLICATIONS

International Search Report and Written Opinion dated Oct. 8, 2020 in counterpart application No. PCT/RU2020/050094; w/English partial translation and partial machine translation (total 15 pages).
(Continued)

*Primary Examiner* — Cassey D Bauer
(74) *Attorney, Agent, or Firm* — Seckel IP, PLLC

(57) ABSTRACT

The bifunctional compression refrigerator located inside a building includes a thermally insulated cabinet (1) with an evaporator (3), a motor-driven compressor (4), a condenser (5), a temperature controller (10), a first temperature sensor (11), and a ventilation module (12) including a housing (13), an inlet ventilation pipe (14), and outlet ventilation pipe (15), and a fan (16). The inlet ventilation pipe (14) and the outlet ventilation pipe (15) are arranged on the opposite sides of the housing (13). The fan (16) is installed inside the housing (13) between the inlet ventilation pipe (14) and the outlet ventilation pipe (15). The housing (13) is arranged on the thermally insulated cabinet (1). The condenser (5) is 20 installed inside the housing (13). The housing (13) is configured to have access to an outdoor air outside the building.

8 Claims, 7 Drawing Sheets

Figure 1:
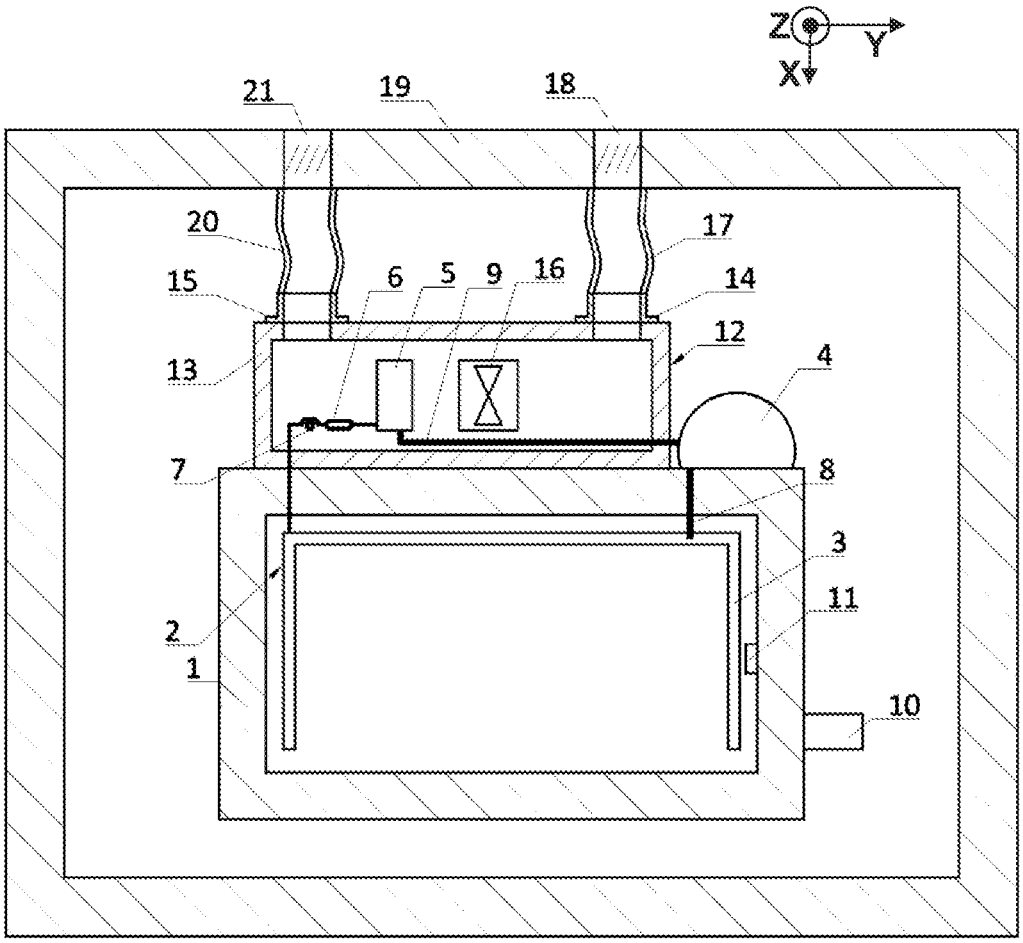

(58) Field of Classification Search
CPC . F25D 23/12; F24F 1/027; F24F 7/013; F24F 2221/20; F24F 2221/18; F24F 5/0096
See application file for complete search history.

(56) References Cited

U.S. PATENT DOCUMENTS

| | | | | |
|---|---|---|---|---|
| 2005/0183438 | A1* | 8/2005 | Sessa | F25D 23/10 62/317 |
| 2009/0241567 | A1 | 10/2009 | Hausmann et al. | |
| 2012/0000232 | A1* | 1/2012 | Cieslik | F25D 19/00 62/291 |

FOREIGN PATENT DOCUMENTS

| | | | | |
|---|---|---|---|---|
| CN | 109631210 | * | 4/2019 | F24F 5/0096 |
| JP | 2019113244 | A | 7/2019 | |
| KR | 1020130137401 | A | 12/2013 | |
| RU | 22990 | U1 | 5/2002 | |
| RU | 37810 | U1 | 5/2004 | |
| RU | 2342609 | C1 | 12/2008 | |
| RU | 2438077 | C2 | 12/2011 | |
| RU | 2716444 | C1 | 3/2020 | |
| SU | 947584 | A1 | 7/1982 | |
| SU | 1742597 | A1 | 6/1992 | |
| WO | 2008025648 | A2 | 3/2008 | |
| WO | 2013180618 | A1 | 12/2013 | |

OTHER PUBLICATIONS

Veinberg et al., "Household Compression Fridges", Moscow Food Industry, 1974, pp. 25-30; w/English translation (total 16 pages) cited in the Specification.

* cited by examiner

BIFUNCTIONAL COMPRESSION REFRIGERATOR

The invention relates to a refrigeration, air conditioning and ventilation equipment, and can be used to improve the indoor microclimate.

A compression indoor refrigerator is known from the prior art (Veynberg B. S., Vayn L. N., Household compression refrigerators, Moscow, Pishchevaya Promyshlennost, 1974, pp. 25-30), consisting of a thermally insulated cabinet with an evaporator, a filter-dryer, a capillary tube, and a motor-driven compressor with an air-cooled condenser mounted on the thermally insulated refrigerator cabinet. The operation of the refrigerator is accompanied by various physical processes resulting from a vapor-compression cycle taking place within the refrigeration circuit thereof, such as a heat generation in the condenser and an indoor dissipation of this heat. During the cold season, such heat generation improves the indoor microclimate.

However, during the warm season, and especially in hot climates, the excessive heat worsens the indoor microclimate, and creates an additional load on an air conditioning device, if any, leading to increased energy consumption.

An indoor dual-function refrigerator is know from the prior art (CN 2264347Y), which combines the refrigeration and air conditioning functions. This device combines two functional modules, including a refrigeration module and an air conditioning module arranged inside the building. The modules have a common motor-driven compressor and a condenser, but separate evaporators. The motor-driven compressor and the condenser with forced air cooling are located outside of the building, which is not always permissible due to the architectural and administrative restrictions of the building. In addition, the dual function of the device is achieved by mechanically combining two functionally independent modules: a refrigeration module and an air conditioning module. Furthermore, each module retains its own functions without expanding them.

The closest technical solution, selected as a prototype, is a household refrigerator (RU 2342609) intended for use in cold climates, which consists of indoor and outdoor units. The indoor unit is located inside the building and consists of a thermally insulated cabinet with an evaporator, a temperature sensor, and a temperature controller. A motor-driven compressor and a condenser are arranged as the outdoor unit installed outside of the budding and connected with the indoor unit via direct and return lines of the refrigeration circuit. Furthermore, the refrigerator is further provided with an additional liquid coolant heat circuit comprising a heat exchanger in the indoor unit and a radiator in the outdoor unit. The heat exchanger and radiator are also interconnected via direct and return lines. The liquid coolant inside the additional heat circuit is circulated by a pump. In this case, both the condenser of the refrigerator and the radiator are cooled by outside air.

The arrangement of the outdoor unit outside the building, as in the previous example, is not always acceptable due to the architectural and administrative restrictions of the building. In addition, extended length of the lines connecting the outdoor and indoor units causes higher hydraulic resistance when circulating refrigerant through the refrigeration circuit. This increases the load on the motor-driven compressor, which results in higher energy consumption by the refrigerator.

During the cold season, the motor-driven compressor of the refrigerator is turned off, and the thermally insulated cabinet is cooled due to a natural external cold by pumping the liquid coolant through the additional heat circuit connecting the outdoor and indoor units. During such process, the heat penetrating inside the thermally insulated cabinet from the room is carried outside by the coolant. As a result, the indoor temperature decreases, which worsens the microclimate and imposes an additional load on the heating and air conditioning device, if any. This, in turn, leads to an increased consumption of energy required to maintain a comfortable microclimate.

During the warm season, the additional heat circuit is disconnected, the motor-driven compressor is turned back on, and the refrigeration circuit operates as in a conventional refrigerator. In this case, the heat penetrating inside the thermally insulated cabinet from the room is also carried outside by the coolant in the process of a vapor-compression cycle. As a result, same as during the cold season, the indoor temperature decreases. However, even during the warm season, reducing indoor temperature is not always necessary, for example, in case of cool weather, when it becomes desirable to warm-up the building by turning on the heating or air conditioning device, which subsequently increases the consumption of energy required to maintain a comfortable microclimate.

Thus, regardless of the indoor microclimate, the prototype consistently realizes only one cooling mode. As a result, the device does not provide a comfortable indoor microclimate on a year-round basis, and increases the consumption of energy required to maintain a comfortable indoor microclimate due to additional energy consumed by the air conditioning device. The device lacks the microclimate improvement modes with respect to improving the quality of an indoor air.

The objective of the invention is to expand the functionality of the refrigerator by imparting the device with the properties of an air conditioner.

The technical result of the invention consists of improving the indoor microclimate and reducing the energy consumption.

The specified technical result is achieved by introducing the following changes to a bifunctional compression refrigerator located inside a building and including a thermally insulated cabinet with an evaporator, a condenser, a motor-driven compressor, a temperature controller, and a first temperature sensor. The refrigerator is complemented with a ventilation module consisting of a housing, an inlet ventilation pipe, an outlet ventilation pipe, and a fan. The inlet and outlet ventilation pipes are arranged on the opposite sides of the housing, while the fan is installed inside the housing between the inlet ventilation pipe and the outlet ventilation pipe. The condenser is installed inside the housing, the housing is configured to have access to an outdoor air outside the building. The condenser is cooled by the air passing through the housing.

In the specific embodiments of the proposed device, the housing connection to the outdoor air can be accomplished using various methods. In case of existing supply and exhaust ventilation inside the building, within which the refrigerator is located, the housing can be connected to the outdoor air by connecting the inlet ventilation pipe to a supply grill of the supply and exhaust ventilation, and by connecting the outlet ventilation pipe to an exhaust grill of the supply and exhaust ventilation device. In the absence of the supply and exhaust ventilation inside the building, supply and exhaust grills for connecting the inlet and outlet ventilation pipes are arranged in a building external wall or a window.

During the operation of the bifunctional compression refrigerator, in the process of a vapor-compression cycle inside its refrigeration circuit, there are a heat generated in the condenser, which penetrates into the thermally insulated cabinet from the interior of the building, and a heat produced by the motor-driven compressor. The ability to establish the connection between the housing and the outdoor air results in this heat being removed from the condenser by the flow of the outdoor air, which carries it outside of the building, thus, enabling cooling of the building during the hot season. During the cold season, the housing is connected to the indoor air, and the heat remains inside the building due to recirculation of the indoor air through the housing, which leads to an increase in an indoor temperature. The indoor microclimate improvement modes with respect to the air quality have also been realized by using the exhaust and supply ventilation. The operation of the device in the refrigeration mode occurs in the typical manner based on the readings of the first temperature sensor, while helping to maintain the heat balance and improving the indoor microclimate without requiring any additional consumption of energy.

Switching the air flows passing through the housing helps realize various additional modes of refrigerator functionalities.

According to the basic embodiment of the device, the connection between the housing and both the indoor and outdoor air is realized by means of the inlet and outlet ventilation pipes. Switching the air flows passing through the housing is performed manually by connecting or disconnecting the air ducts joining the inlet ventilation pipe to the supply grill and the outlet ventilation pipe to the exhaust grill.

In the specific embodiment of the device, to ensure the direct connection to the indoor air, an inlet vent, geometrically coupled to the inlet ventilation pipe, and an outlet vent, geometrically coupled to the outlet ventilation pipe, are arranged inside the housing. A first switching unit is arranged between the inlet vent and the inlet ventilation pipe, said first switching unit being configured to open the inlet vent and to close the inlet ventilation pipe, as well as to close the inlet vent and to open the inlet ventilation pipe. A second switching unit is arranged between the outlet vent and the outlet ventilation pipe, said second switching unit being configured to open the outlet vent and to close the outlet ventilation pipe, and to close the outlet vent and to open the outlet ventilation pipe. A second temperature sensor and a control unit are arranged on the thermally insulated cabinet, while the control unit is integrated with the temperature controller.

It is preferable to use electrically-driven switching units operated by the control unit arranged inside the refrigerator. The switching of the air flows in this specific embodiment of the device is performed automatically via the first and second switching units operated by the control unit.

In another embodiment of this device, the motor-driven compressor is arranged on the thermally insulated cabinet.

In yet another embodiment of this device, the motor-driven compressor is installed inside the housing.

In yet another embodiment of this device, a first air filter is arranged inside the inlet ventilation pipe.

In yet another embodiment of this device, a first air filter is arranged inside the inlet ventilation pipe, and a second air filter is arranged inside the inlet vent.

In yet another embodiment of this device, the housing is thermally insulated.

The thermal insulation localizes the heat transfer process between the condenser and the condenser-cooling air inside the housing, thus, cutting off the direct heat transfer between the indoor air and the condenser-cooling air. In addition, the thermal insulation helps suppress a noise from the fan and the motor-driven compressor installed inside the housing.

Figure 2:
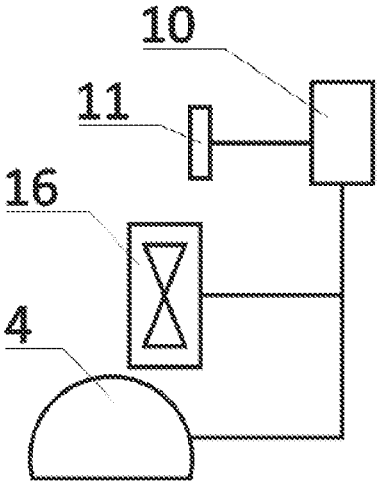
Figure 3:
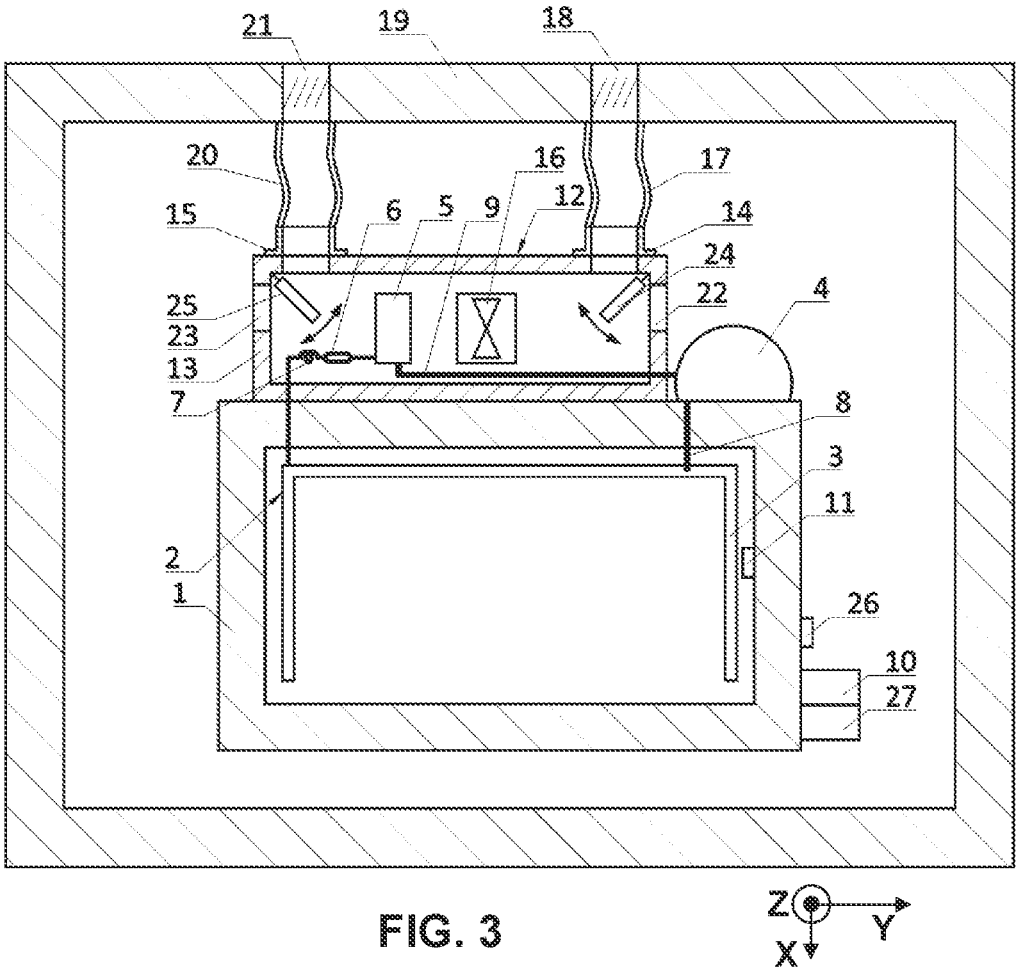
Figure 4:
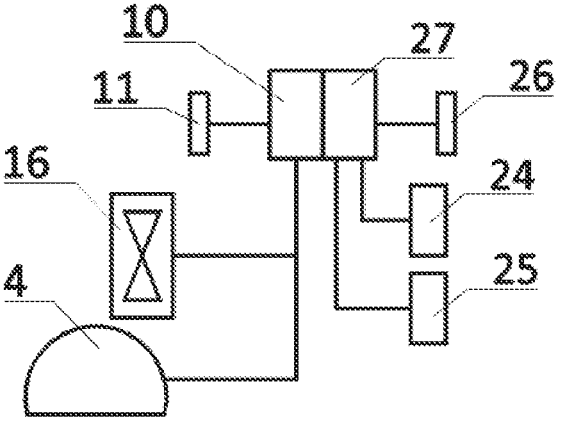
Figure 5:
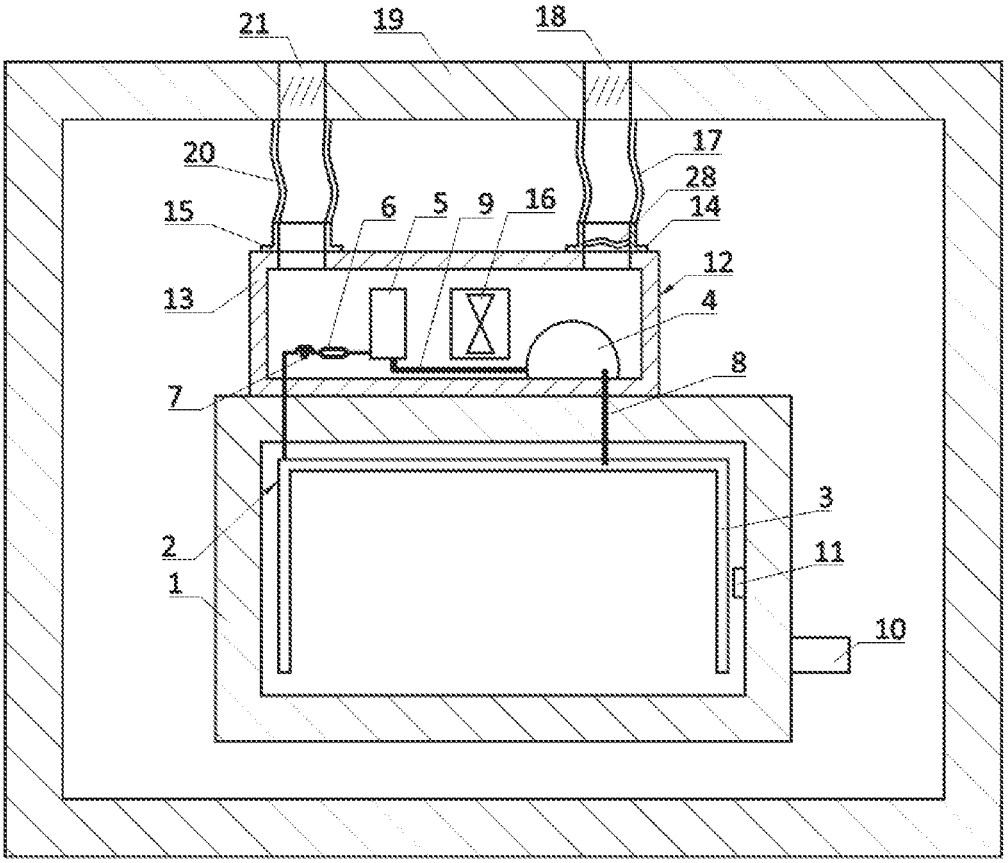
Figure 5:
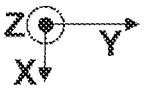
Figure 6:
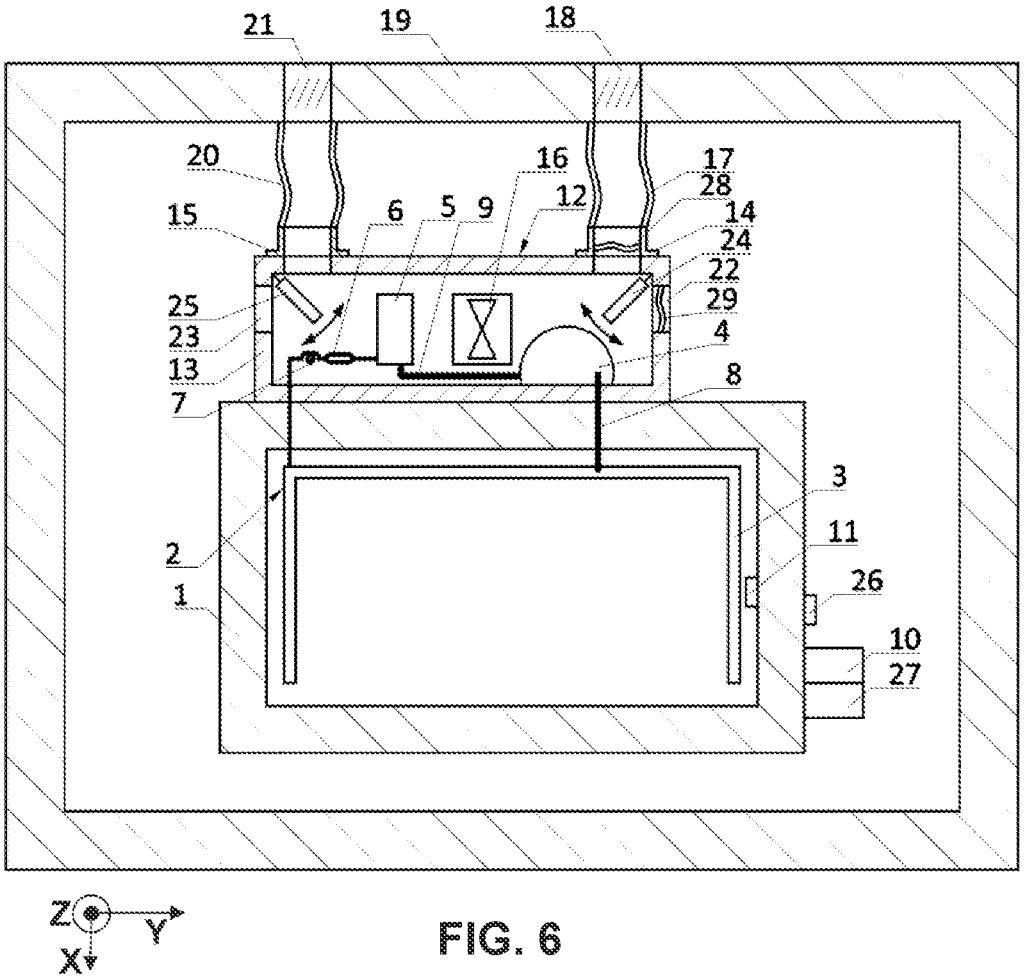
Figure 7:
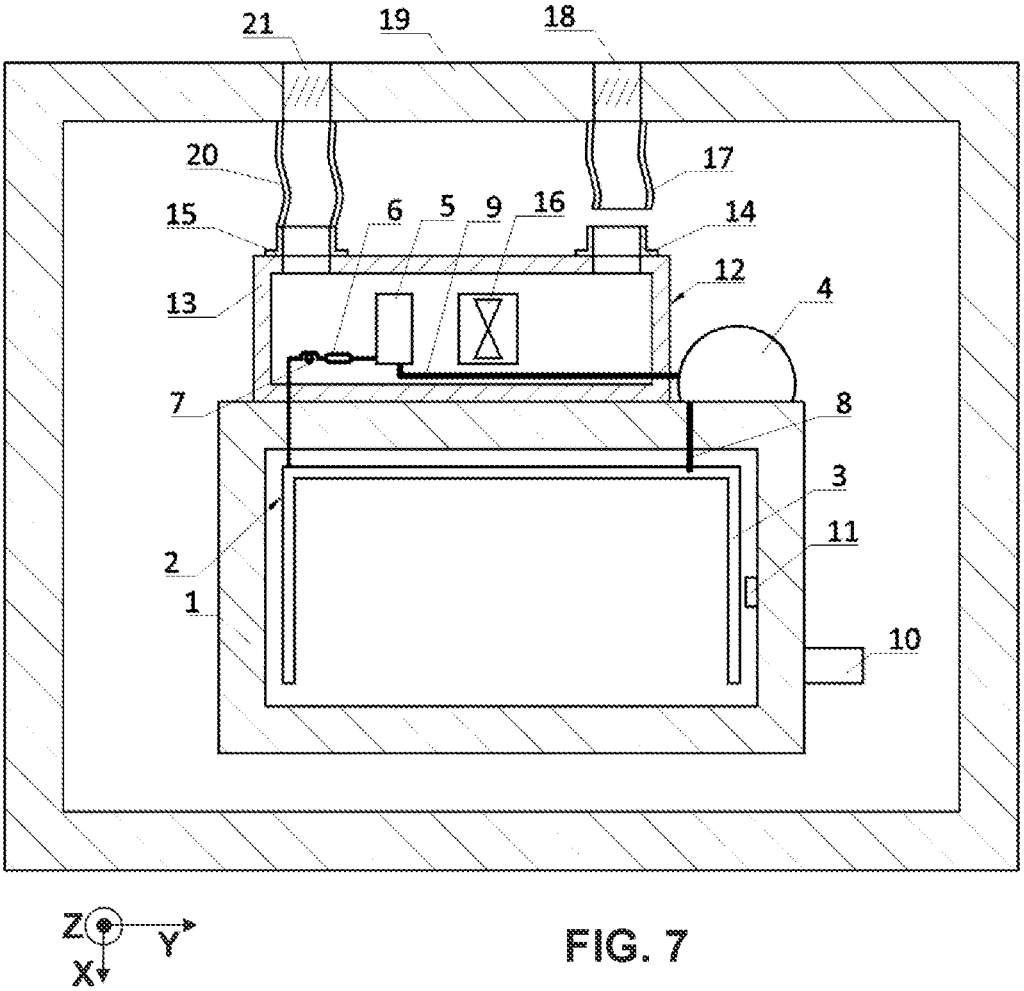
Figure 8:
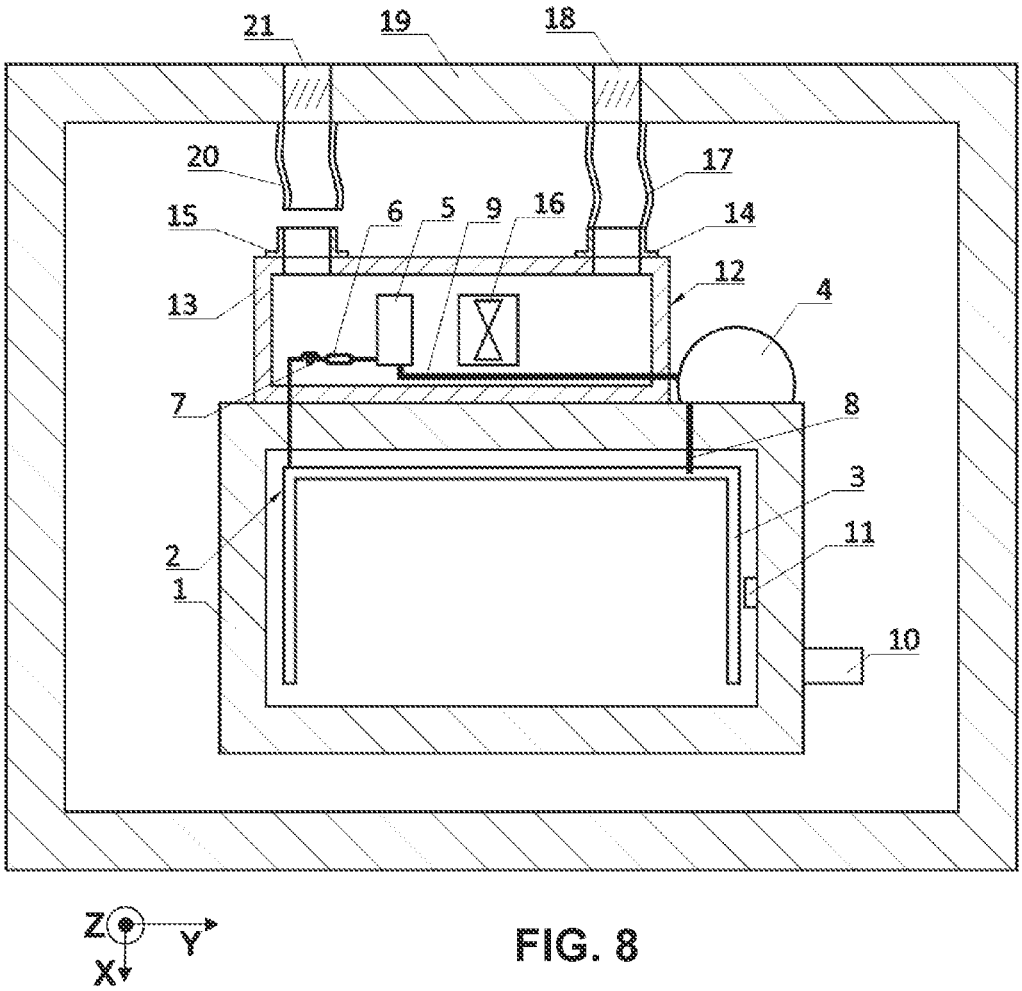
Figure 9:
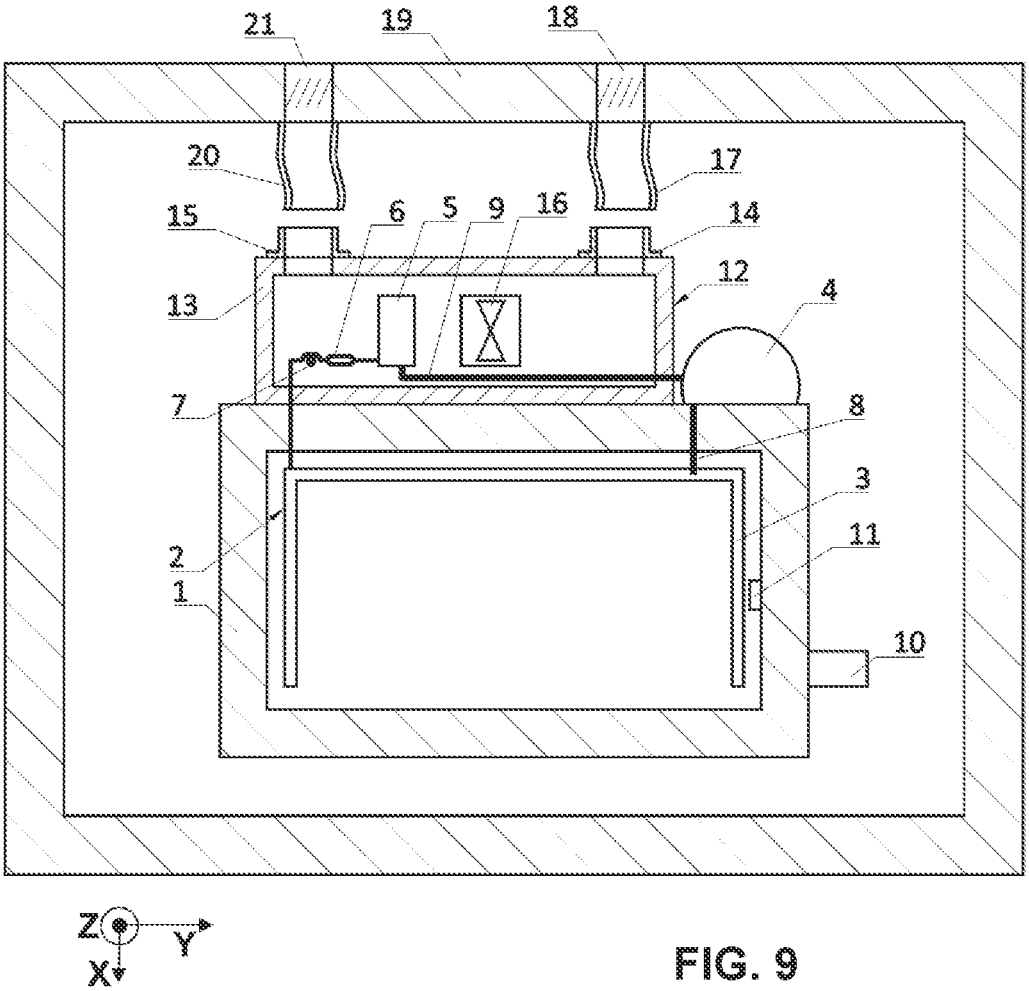

Other distinctive features and advantages of the invention clearly follow from a non-limiting description provided below for illustration purposes referencing the following drawings, in which:

FIG. 1 schematically represents a simplified sectional plan view (along the XY-plane in the orthogonal XYZ coordinate device) of a first version of the device (i.e. of a bifunctional compression refrigerator) according to the invention (basic embodiment) with a motor-driven compressor located on a thermally insulated cabinet and connected inlet and outlet air ducts;

FIG. 2 represents a structural diagram of a temperature control inside the thermally insulated cabinet;

FIG. 3 schematically represents a simplified sectional plan view (along the XY-plane) of a second version of the device according to the invention (specific embodiment) comprising inlet and outlet vents located inside a housing, switching units, the motor-driven compressor placed on the thermally insulated cabinet, and connected inlet and outlet air ducts;

FIG. 4 represents a structural diagram of a control unit integrated with the temperature controller;

FIG. 5 schematically represents a simplified sectional plan view (along the XY-plane) of a third version of the device according to the invention (basic embodiment) with the motor-driven compressor located inside the housing and an air filter installed in an inlet ventilation pipe;

FIG. 6 schematically represents a simplified sectional plan view (along the XY-plane) of the fourth version of the device according to the invention (specific embodiment) with the motor-driven compressor installed inside the housing, a first air filter arranged in the inlet ventilation pipe, and a second air filter arranged in the inlet vent;

FIG. 7 schematically represents a simplified sectional plan view (along the XY-plane) of the fifth version of the device according to the invention (basic embodiment) with connected outlet air duct, but disconnected inlet air duct;

FIG. 8 schematically represents a simplified sectional plan view (along the XY-plane) of the sixth version of the device according to the invention (basic embodiment) with connected inlet air duct, but disconnected outlet air duct;

FIG. 9 schematically represents a simplified sectional plan view (along the XY-plane) of the sixth version of the device according to the invention (basic embodiment) without connected inlet and outlet air ducts.

A basic embodiment (FIG. 1, FIG. 2) of a device (i.e. a bifunctional compression refrigerator located inside a building 19) includes a thermally insulated cabinet 1 and a refrigeration circuit 2. This refrigeration circuit 2 comprises an evaporator 3, a motor-driven compressor 4, and a condenser 5.

This refrigeration circuit 2 may further comprise (see an example of the device shown in FIG. 1) a filter-dryer 6, a capillary tube 7, a suction line 8, and a discharge line 9.

The basic embodiment (FIG. 1, FIG. 2) of the refrigerator also comprises a temperature controller 10 and a first temperature sensor 11. In the example shown in FIG. 1, the temperature controller 10 and the first temperature sensor 11 are mounted on the thermally insulated cabinet 1.

According to the invention, the refrigerator includes a ventilation module 12. This ventilation module 12 comprises a housing 13, an inlet ventilation pipe 14, and an outlet ventilation pipe 15. Furthermore, the inlet ventilation pipe 14 and the outlet ventilation pipe 15 are arranged on the opposite sides of the housing 13 (in the example, shown in FIG. 1, the inlet ventilation pipe 14 is arranged on the right side of the housing 13, while the outlet ventilation pipe 15 is arranged on the left side of the housing 13). According to the invention, the refrigerator also comprises a fan 16, which is installed inside the housing 13 between the inlet ventilation pipe 14 and the outlet ventilation pipe 15 (FIG. 1). The housing 13 is arranged on the thermally insulated cabinet 1 (FIG. 1). The condenser 5 is installed inside the housing 13 (FIG. 1). The housing 13 is configured to have access to the outdoor air outside the building 19.

It is preferable to thermally insulate the housing 13 using a foamed polyethylene coating. Alternatively, the housing 13 can be fabricated from a polystyrene foam.

The example shown in FIG. 1 illustrates a first operating mode of the device. Under these conditions, the inlet ventilation pipe 14 is connected via an inlet air duct 17 to a supply grill 18 arranged in an external wall of the building 19. The outlet ventilation pipe 15 is connected via an outlet air duct 20 to an exhaust grill 21 arranged in the external wall of the building 19.

It is preferable to use thermally insulated flexible air ducts as the inlet air duct 17 and the outlet air duct 20. The flexibility of the air ducts 17 and 20 allows moving the device relative to the supply grill 18 and to the exhaust grill 21 arranged in the external wall of the building 19. The thermal insulation of the air ducts 17 and 20 reduces an uncontrolled direct heat transfer between an indoor air from the interior of building 19, where the refrigerator is arranged, and an air passing through the air ducts 17 and 20.

In the example shown in FIG. 1, the motor-driven compressor 4 is arranged on the thermally insulated cabinet 1.

Alternatively, the motor-driven compressor 4 can also be arranged inside the housing 13 (not shown in FIG. 1).

The temperature controller 10 is electrically connected to the first temperature sensor 11 the motor-driven compressor 4, and the fan 16 (FIG. 2).

In the specific embodiment of the device (FIG. 3, FIG. 4), an inlet vent 22 geometrically coupled to the inlet ventilation pipe 14 and an outlet vent 23 geometrically coupled to the outlet ventilation pipe 15 are arranged inside the housing 13.

Under these conditions, a first switching unit 24 is arranged between the inlet vent 22 and the inlet ventilation pipe 14, said first switching unit 24 being configured:

- to open the inlet vent 22 and to close the inlet ventilation pipe 14, and
- to close the inlet vent 22 and to open the inlet ventilation pipe 14.

Under these conditions, a second switching unit 25 is arranged between the outlet vent 23 and the outlet ventilation pipe 15, said second switching unit 25 being configured:

- to open the outlet vent 23 and to close the outlet ventilation pipe 15, and
- to close the outlet vent 23 and to open the outlet ventilation pipe 15.

The first switching unit 24 and the second switching unit 25 can be embodied, for example, in the form of electrically driven air reversing valves. Alternatively, electric air dampers can be installed on the inlet vent 22, the inlet ventilation pipe 14, the outlet vent 23, and the outlet ventilation pipe 15.

Under these conditions, as shown in the example illustrated by FIG. 3, arranged on the thermally insulated cabinet 1 are:

- a second temperature sensor 26, and
- a control unit 27 intended for controlling the first switching unit 24 and second switching unit 25.

Furthermore, the control unit 27 is integrated with the temperature controller 10.

As shown in FIG. 4, the control unit 27 can be electrically connected with the second temperature sensor 26, the first switching unit 24, and the second switching unit 25. In this case, the temperature controller 10 can be electrically connected with the first temperature sensor 11, the motor-driven compressor 4, and the fan 16 (FIG. 4).

Both basic and specific embodiments of the device (FIG. 1, FIG. 3) provide for an optional installation of the motor-driven compressor 4 inside the housing 13 (FIG. 5, FIG. 6).

The example shown in FIG. 5 depicts a first air filter 28, which can be arranged within the inlet ventilation pipe 14.

In the example shown in FIG. 6, the device comprises:

- the first air filter 28, which can be arranged within the inlet ventilation pipe 14, and
- a second air filter 29, which can be arranged within the inlet vent 22.

According to the basic embodiment of the device, during its operation in a building 19 cooling mode concurrently with an exhaust ventilation, the outlet air duct 20 is connected to the outlet ventilation pipe 15. Under these conditions, the inlet air duct 17 is disconnected from the inlet ventilation pipe 14 (FIG. 7): this example illustrates a second operating mode of the device.

According to the basic embodiment of the device, during its operation in a forced ventilation mode with an air heating, the inlet air duct 17 is connected to the inlet ventilation pipe 14. Under these conditions, the outlet air duct 20 is disconnected from the outlet ventilation pipe 15 (FIG. 8): this example illustrates a third operating mode of the device.

According to the basic embodiment of the device, during its operation in an indoor heating mode, the inlet air duct 17 is disconnected from the inlet ventilation pipe 14, and the outlet air duct 20 is disconnected from the outlet ventilation pipe 15 (FIG. 9): this example illustrates a fourth operating mode of the device.

The motor-driven compressor 4 is arranged either on the thermally insulated cabinet 1 (FIG. 1, FIG. 3, FIGS. 7-9), or installed inside the housing 13 (FIG. 5, FIG. 6).

The installation of the motor-driven compressor 4 on the thermally insulated cabinet 1 (FIG. 1, FIG. 3, FIGS. 7-9) leads to a decreased length of the refrigeration circuit 2 compared to the prototype and, hence, to a decreased hydraulic resistance to refrigerant passing through the circuit 2 during the vapor-compression cycle. As a result, the load on the motor-driven compressor 4 is lowered, and the energy consumption is reduced.

The placement of the motor-driven compressor 4 inside the housing 13 (FIG. 5, FIG. 6) allows removing a heat generated due to heat losses in the motor-driven compressor 4 by carrying it outdoors, which helps cool the building under respective operating modes of the device. In addition, noises produced by the running motor-driven compressor 4 is also reduced.

FIGS. 1, 3, and 5-9 show a relative positioning of the fan 16 and the condenser 5 inside the housing 13 placed sequentially one after another between the inlet ventilation pipe 14 and the outlet ventilation pipe 15. In addition, the design allows combining the fan 16 and the condenser 5 in a single unit (not shown in FIG. 1, FIG. 3, FIGS. 5-9).

When the motor-driven compressor 4 is arranged inside the housing 13 as depicted in FIG. 5 and FIG. 6, the motor-driven compressor 4, the fan 16 and the condenser 5 are shown to be positioned sequentially one after the other inside the housing 13 between the inlet ventilation pipe 14 and outlet ventilation pipe 15. This design is advantageous, since it allows cooling the motor-driven compressor 4 using the coldest air, entering the housing 13, which has not yet been heated from the condenser 4.

According to the basic embodiment of the device, it is possible to install the first air filter 28 in the inlet ventilation pipe 14 (FIG. 5), and according to the specific embodiment of the device, it is possible to install the first air filter in the inlet ventilation pipe 14 and the second air filter in the inlet vent 22 (FIG. 6) to prevent a contamination of the condenser 5. The contamination of the condenser 5 may lead to a decreased performance of the refrigeration circuit 2 and an excessive energy consumption during operation of the motor-driven compressor 4.

The device operates as follows:

When an internal temperature inside the thermally insulated cabinet 1 (FIG. 1) rises due to the penetration of heat from the interior of the building 19, and the reference value $T_1$, measured by the first temperature sensor 11 and set by the temperature controller 10, is reached, the temperature controller 10 activates the motor-driven compressor 4 and the fan 16 connected in parallel therewith. The motor-driven compressor 4 pumps the refrigerant through the refrigeration circuit 2. As a result of the performed vapor-compression refrigeration cycle, the evaporator 3 is cooled and the condenser 5 is heated by the amount of heat $Q_1$ penetrating from the interior of building 19 inside the thermally insulated cabinet 1 and then transferred by the refrigerant from the evaporator 3 to the condenser 5. In addition, the condenser 5 generates the amount of heat $Q_2$ equal to the amount of work performed by the motor-driven compressor 4 during a completion of the vapor-compression refrigeration cycle. During such process, the refrigeration circuit 2 of the refrigerator operates as a heat pump converting the heat from the interior of the building to the heat generated by the condenser 5. The fact that the temperature of the external surface of thermally insulated cabinet 1 is from one to two degrees lower than the temperature inside the building 19 serves as a visual demonstration of this process, Despite such an insignificant temperature difference, there is a significant amount of heat transferred from the interior of the building 19 to the condenser 5 due to a quite large external surface area of the thermally insulated cabinet 1 (about 5 $m^2$). The reference temperature value inside thermally insulated cabinet 1 was set as $T_1$=+5 degrees, and the comfortable air temperature inside the building was set as $T_2$=+25 degrees. The thermal insulation of the thermally insulated cabinet 1 is made of a polystyrene foam having a thermal conductivity of 0.05 W/m*deg and a wall thickness of 0.05 m. Under such conditions, the amount of heat transfer from the interior of the building to the thermally insulated cabinet 1 is 100 W. Such amount of heat is being transferred constantly throughout the day as long as the temperature inside the thermally insulated cabinet 1 is maintained at a $T_1$ level. The amount of energy $Q_1$ penetrated from the interior of the building 19 into the thermally insulated cabinet 1 during the day is $Q_1$=100 W*24 hours=2.4 kW*hour. Next, this energy $Q_1$ is transferred to the condenser 5, where the additional energy $Q_2$ is generated, said additional energy $Q_2$ being equal to the work performed by the motor-driven compressor 4 during the vapor-compression cycle in the refrigeration circuit 2. The energy consumption by the device E constitutes 0.8 kW*hour per day. Under these conditions, practically all electrical energy is spent on performing a vapor-compression cycle, hence $Q_2$=E=0.8 кW*h per day. The total amount of heat $Q=Q_1+Q_2$, generated by the condenser 5, is removed by the air blown at the condenser 5 by the fan 16. A resulting effect on the indoor microclimate of the budding depends on the air paths through the housing 13, namely, on the source of the air flow (the indoor air from the building interior or the outdoor air) entering the housing 13 and cooling the condenser 5, as well as on the direction of the air exiting the housing 13 (inside the building or outside).

Various paths of the air passage through the housing 13 can be realized in the basic embodiment of the device by combining potential ways of connecting the inlet air duct 17 to the inlet ventilation pipe 14, and the outlet air duct 20 to the outlet ventilation pipe 15 (FIG. 1, FIG. 6, FIGS. 7-9), which is performed manually. In case of the specific embodiment of the device (FIG. 3 and FIG. 5), various air paths through the housing 13 can be realized by permanently connecting the inlet air duct 17 to the inlet ventilation pipe 14 and the outlet duct 20 to the outlet ventilation pipe 15 by switching positions of the first switching unit 24 and the second switching unit 25. These switchings are performed based on the readings of the second temperature sensor 26 by issuing a command from the control unit 27 to the switching units 24 and 25. The reference value of the comfortable temperature inside the building $T_2$ measured by the second temperature sensor 26 is programmed into the control unit 27. The control unit 27 also has additional settings for the device operating modes enabling an indoor microclimate control, namely:

- a building 19 cooling mode,
- a building 19 cooling mode with a concurrent exhaust ventilation,
- a building heating mode, and
- a forced-air ventilation mode with an air heating.

If the current temperature inside the building exceeds the $T_2$ value, one of the building cooling modes is activated (see below, the first mode or the second mode). If the current temperature inside the building drops below $T_2$, one of the building heating modes is activated (see below, the third mode or the fourth mode).

The device allows for four air paths through the housing 13 and, hence, provides four additional functioning modes of the refrigerator, Each of these four modes is set depending on the need to maintain a certain microclimate inside the building.

The first mode provides cooling of the budding 19. The outdoor air enters through the supply grill 18, the inlet air duct 17, and the inlet ventilation pipe 14, then removes the heat from the condenser 5 while passing through the housing 13, and exits through the outlet ventilation pipe 15, the outlet air duct 20, and the exhaust grill 21. In case of the basic embodiment of the device, this first mode of cooling of the building 19 is realized by connecting the inlet air duct 17 to the inlet ventilation pipe 14, and the outlet air duct 20 to the outlet ventilation pipe 15 (FIG. 1, FIG. 5). In case of the specific embodiment of the device, (FIG. 3 and FIG. 6), this first mode of cooling of the building 19 is realized by sending a command from the control unit 27 to the first switching unit 24, followed by opening the inlet ventilation pipe 14 and closing the inlet vent 22, and by sending a command to the second switching unit 25, followed by opening the outlet ventilation pipe 15 and closing the outlet vent 23. During this first mode of cooling of the building 19, the total amount of heat Q is equal to the sum of the heat $Q_1$, penetrated into thermally insulated cabinet 1 from the interior of the building 19, and the heat 02, approximately equal to the work performed by the motor-driven compressor 4. At the same time, the building 19 is cooled due to removal of the heat $Q_1$, while removal of the heat 02 outdoors prevents this heat from being dissipated inside the building 19, as is the case with conventional refrigerators.

The second mode provides cooling of the building along with the concurrent exhaust ventilation. During this second mode, the indoor air from the interior of the building enters the housing 13. removes a heat from the condenser 5 and carries it outdoors. In case of the basic embodiment of the device, this second mode is realized when the inlet air duct 17 is disconnected from the inlet ventilation pipe 14, and the outlet air duct 20 is connected to the outlet ventilation pipe 15 (FIG. 7). In case of the specific embodiment of the device (FIG. 3 and FIG. 6), this second mode is realized by sending a command from the control unit 27 to the first switching unit 24, followed by closing the inlet ventilation pipe 14 and opening the inlet vent 22, and by sending a command to the second switching unit 25, followed by opening the outlet ventilation pipe 15 and closing the outlet vent 23, During this second mode, same as during the first mode, the same amount of heat is removed from the building 19 with the indoor air as during the first mode, and the interior of the building 19 is cooled.

The importance of the thermal insulation of the housing 13 becomes most critical when the device operates in the first mode or the second mode, since it cuts off the heat transfer from inside the housing 13 to the indoor air of the building 19, which prevents the reduction in efficiency of carrying this heat outdoors. The need to cool the budding 19 arises when the weather is hot, and the temperature of the outdoor air is higher than the temperature inside the building. The lack of the thermal insulation of the housing 13 will lead to the undesirable heating of the indoor air due to the heat transfer from the warm outdoor air passing through the housing 13.

The choice between the first mode and the second mode in case of the specific embodiment of the device is realized by setting the unit 27 to the cooling mode or the cooling mode with the exhaust ventilation.

The third mode realizes the supply ventilation of the building with air heating. During this third mode, the outdoor air enters the housing 13, removes a heat from the condenser 5, and enters the interior of the building. In case of the basic embodiment of the device, this mode is realized when the inlet air duct 17 is connected to the inlet ventilation pipe 14, and the outlet air duct 20 is disconnected from the outlet ventilation pipe 15 (FIG. 8). In case of the specific embodiment of the device (FIG. 3 and FIG. 6), this third mode is realized by sending a command from the control unit 27 to the first switching unit 24, followed by opening the inlet ventilation pipe 14 and closing the inlet vent 22, and by sending a command to the second switching unit, followed by closing the outlet ventilation pipe 15 and opening the outlet vent 23. During this third mode, the air entering the building 19 is heated by the total amount of heat $Q=Q_1+Q_2$ generated in the condenser 5, and the interior of the building 19 is ultimately heated by the amount of heat equal to the amount of energy consumed by the device and approximately equal to the work $Q_2$ performed by the motor-driven compressor 4. The reason for such result to be observed is because the heat $Q_1$ absorbed from the building 19 by the thermally insulated cabinet 1 is compensated by the same amount of heat $Q_1$, received from the evaporator 3, which was generated by the condenser 5 and returned with the outdoor air back into the building 19.

The fourth mode realizes heating of the building. During this mode, when the air passes through the housing 13, the indoor air is recirculated, the heat from the condenser 5 is removed, and this heat is supplied inside the building. In case of the basic embodiment of the device, this fourth mode is realized when the inlet air duct 17 is disconnected from the inlet ventilation pipe 14, and the outlet air duct 20 is disconnected from the outlet ventilation pipe 15 (FIG. 9). In case of the specific embodiment of the device (FIG. 3 and FIG. 6), this fourth mode is realized by sending a command from the control unit 27 to the first switching unit 24, followed by closing the inlet ventilation pipe 14 and opening the inlet vent 22, and by sending a command to the second switching unit, followed by closing the outlet ventilation pipe 15 and opening the outlet vent 23, During this fourth mode, same as during the third mode, the building 19 is heated by the amount of heat $Q_2$, approximately equal to the work performed by the motor-driven compressor 4.

The choice between the third mode and the fourth mode in case of the specific embodiment of the device is realized by setting the forced air ventilation mode with the air heating or the building heating mode.

All additional functions of the device related to the improvement of the indoor microclimate are realized concurrently to its operation as a refrigerator, in the process of operating its refrigeration circuit 2. During the building cooling mode, the device complements the function of an air conditioning device while consuming 0.8 kW*hour of electric energy per day. The energy efficiency coefficients of the refrigeration circuits of the compressor refrigerators and air conditioners are close, therefore, the energy consumption by an air conditioner required to maintain the same level of comfortable temperature $T_2$ inside the building is reduced by approximately the same value of E=0.8 kW*hour per day. The amount of heat $Q_1$ is proportional to the temperature difference $(T_2-T_1)$. When temperature $T_1$ drops to 15 degrees, the device operates as a freezer. In this case, the amount of heat transferred from the interior of building 19 to the thermally insulated cabinet and then outside of the building increases to 200 W, the $Q_1$ value increases to 4.8 kW*hour, and the energy savings are 1.6 kW*hour per day. When the device operates in different modes, no additional energy is required, and the energy consumption is reduced.

By complementing the refrigerator with the ventilation module 12, consisting of (see example in FIG. 1) the housing 13, the inlet ventilation pipe 14, the outlet ventilation pipe 15, and the fan 16, wherein the inlet ventilation pipe 14 and the outlet ventilation pipe 15 are arranged on the opposite sides of the housing 13, while the fan 16 is installed inside the housing 13 between the inlet ventilation pipe 14 and the outlet ventilation pipe 15, the housing 13 is arranged on the thermally insulated cabinet 1 and the condenser 5 is installed inside the housing 13, where the housing 13 is configured to have access to the outdoor air outside the building 19, it becomes possible to transfer heat from the condenser 5 to either the outdoor air (outside the budding 19) or the indoor air (inside the building 19) circulated through the housing 13 by the fan 16. Depending on the direction of the air flows passing through housing 13, this heat is:

- either carried outside the building 19, thus, causing the latter to cool,
- or remains inside, thus, heating the building 19.

An indoor microclimate improvement inside the building 19 also takes place with respect to the air quality by integrating the exhaust or supply ventilation with the respective operating modes of the device.

Thus, the indoor microclimate improvement inside the building 19 is realized concurrently with the device's main function, which is refrigeration, and does not require additional energy consumption. The total household energy consumption decreases.

The fact that the housing 13 is provided with the inlet vent 22 geometrically coupled to the inlet ventilation pipe 14 and the outlet vent 23 geometrically coupled to the outlet ventilation pipe 15; the first switching unit 24 is arranged between the inlet vent 22 and the inlet ventilation pipe 14 and configured to open the inlet vent 22 and to close the inlet ventilation pipe 14, and to close inlet vent 22 and to open the inlet ventilation pipe 14; the second switching unit 25 is installed between the outlet vent 23 and the outlet ventilation pipe 15 and configured to open the outlet vent 23 and to close the outlet ventilation pipe 15, and to close the outlet vent 23 and to open the outlet ventilation pipe 15; the second temperature sensor 26 and the control unit 27 are arranged on the thermally insulated cabinet 1, while the control unit 27 is integrated with the temperature controller 10, causes the device to operate automatically under various microclimate improvement modes.

The fact that motor-driven compressor 4 is arranged on the thermally insulated cabinet 1 leads to a decreased length of the refrigeration circuit 2 compared to the prototype and, hence, to a decreased hydraulic resistance to passing a refrigerant along circuit 2 during the vapor-compression cycle. As a result, the load on the motor-driven compressor 4 is lowered, the energy consumption is reduced.

The fact that the motor-driven compressor 4 is installed inside the housing 13 enables the removal of heat in the cooling mode from the building to the outside, wherein this heat is generated due to heat losses while the motor-driven compressor 4 operates inside its box. Such solution helps improve the indoor microclimate inside the building and reduce the energy consumption required to maintain it. In addition, installing of the motor-driven compressor 4 inside the housing 13 in the flow of the air passing through the housing, helps intensively cool the motor-driven compressor 4.

The fact that in the basic embodiment of the device, the first air filter 28 is arranged inside the inlet ventilation pipe 14 prevents the condenser 5 from becoming contaminated when the air passes through the housing 13. The contamination of the condenser 5 can lead to a decreased efficiency of the refrigeration circuit 2 and an excessive energy consumption during the operation of the motor-driven compressor 4. Installing the first air filter 28 allows preserving the device performance during operation.

The fact that, in the specific embodiment of the device, the first air filter 28 is arranged inside the inlet ventilation pipe 14, and the second air filter 29 is arranged inside the inlet vent 22, prevents the condenser 5 from becoming contaminated when the air passes through the housing 13. The contamination of the condenser 5 can lead to a decreased efficiency of the refrigeration circuit 2 and an excessive energy consumption during the operation of the motor-driven compressor 4. Installing the first air filter 28 and the second air filter 29 allows for preserving the device performance during operation.

The fact that the housing 13 is thermally insulated leads to a decrease in uncontrolled direct heat transfer between the air passing through the housing 13 and the indoor air inside the building 19. The uncontrolled heat transfer reduces the efficiency of the heat flux distribution during a device operation in various microclimate improvement modes. The thermal insulation of the housing 13 eliminates this uncontrolled heat transfer and helps improve the microclimate and reduce the energy consumption. In addition, the thermal insulation of the housing 13 helps reduce the noise from the fan 16 and the motor-driven compressor 4 when the latter is placed inside the housing 13.

The preferable use of the device, either as the basic (FIG. 1) or specific (FIG. 3) embodiment, as well as its operating mode depends on the climatic zone of an intended use. In tropical and equatorial climates, it is preferable to use the basic embodiment of the device operating in the cooling mode (FIG. 1 or FIG. 5) and in the cooling mode with the exhaust ventilation (FIG. 7). In mild climates, it is preferable to use the specific embodiment of the device (FIG. 3 or FIG. 6) in various operating modes with an automatic redirection of the air flows by means of the switching units 24 and 25.

Performing additional functions by the device improves the indoor microclimate and does not require extra energy in addition to what the device consumes when functioning as a conventional refrigerator. The maximum reduction in the energy consumption occurs during a continuous operation of the device in the building cooling mode, which is especially important in hot climates, Under these conditions, almost all the electric energy consumed by the device is spent on maintaining the indoor temperature at a comfortable level $T_2$ while concurrently maintaining the temperature at a desired level $T_1$ inside thermally insulated cabinet 1.

The invention claimed is:

1. A bifunctional compression refrigerator located inside a building, wherein the refrigerator comprises:

a thermally insulated cabinet equipped with an evaporator, a motor-driven compressor, a condenser, a temperature controller, a first temperature sensor, and a ventilation module, wherein the ventilation module comprises:

a housing, an inlet ventilation pipe, an outlet ventilation pipe, and a fan, wherein the inlet ventilation pipe and the outlet ventilation pipe are arranged on the opposite sides of the housing, wherein the fan is installed inside the housing between the inlet ventilation pipe and the outlet ventilation pipe, wherein the housing is arranged on the thermally insulated cabinet, wherein the condenser is installed inside the housing, and wherein the housing is configured to have access to an outdoor air outside the building, wherein an inlet vent geometrically coupled to the inlet ventilation pipe and an outlet vent geometrically coupled to the outlet ventilation pipe are arranged inside the housing, wherein a first switching unit is arranged between the inlet vent and the inlet ventilation pipe, the first switching unit being configured;

to open the inlet vent and to close the inlet ventilation pipe, and to close the inlet vent and to open the inlet ventilation pipe, wherein a second switching unit is arranged between the outlet vent and the outlet ventilation pipe, the second unit being configured:

to open the outlet vent and to close the outlet ventilation pipe, and to close the outlet vent and to open the outlet ventilation pipe, wherein a second temperature sensor and a control unit are arranged on the thermally insulated cabinet, and wherein the control unit is integrated with the temperature controller.

2. The refrigerator according to claim 1, wherein the motor-driven compressor is arranged on the thermally insulated cabinet.

3. The refrigerator according to claim 1, wherein the motor driven compressor is installed inside the housing.

4. The refrigerator according to claim 1, wherein a first air filter is arranged inside the inlet ventilation pipe.

5. The refrigerator according to claim 2, wherein a second air filter is arranged inside the inlet vent.

6. The refrigerator according to claim 1, wherein the housing is thermally insulated.

7. The refrigerator according to claim 4, wherein the motor driven compressor is installed inside the housing.

8. The refrigerator according to claim 4, wherein the housing is thermally insulated.

* * * * *